US007013873B2

(12) United States Patent
Oomori

(10) Patent No.: US 7,013,873 B2
(45) Date of Patent: Mar. 21, 2006

(54) APPARATUS AND METHOD FOR CONTROLLING FUEL INJECTION IN INTERNAL COMBUSTION ENGINE

(75) Inventor: Yuzuru Oomori, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/114,117

(22) Filed: Apr. 26, 2005

(65) Prior Publication Data

US 2005/0235960 A1 Oct. 27, 2005

(30) Foreign Application Priority Data

Apr. 27, 2004 (JP) ..... 2004-132053

(51) Int. Cl.
*F02B 7/00* (2006.01)

(52) U.S. Cl. ..... 123/431; 123/299

(58) Field of Classification Search ..... 123/299, 123/431, 304
See application file for complete search history.

(56) References Cited

U.S. PATENT DOCUMENTS 5,875,743 A * 3/1999 Dickey ..... 123/25 C
6,606,976 B1 * 8/2003 Nagano et al. ..... 123/431

FOREIGN PATENT DOCUMENTS

| | | |
|---|---|---|
| JP | A 3-185242 | 8/1991 |
| JP | A 11-182305 | 7/1999 |
| JP | A 2001-73845 | 3/2001 |
| JP | A 2005-48730 | 2/2005 |

* cited by examiner

*Primary Examiner*—Mahmoud Gimie
(74) *Attorney, Agent, or Firm*—Oliff & Berridge, PLC

(57) ABSTRACT

An electronic control unit computes a first correction value for compensating for the deviation of the actual air-fuel ratio in relation to a target air-fuel ratio when fuel is supplied to each combustion chamber from corresponding port injector and in-cylinder injector such that the ratio of the fuel injection amount of the port injector to the total fuel injection amount of the corresponding port injector and in-cylinder injector seeks a first distribution ratio. The electronic control unit also computes a second correction value for compensating for the deviation of the actual air-fuel ratio in relation to the target air-fuel ratio when fuel is supplied to each combustion chamber from the corresponding injectors such that the ratio of the fuel injection amount of the port injector to the total fuel injection amount of the corresponding injectors seeks a second distribution ratio that is different from the first distribution ratio. Further, the electromagnetic control valve corrects the fuel injection amount of each of the injectors based on the first and second distribution ratios and the first and second correction values.

7 Claims, 3 Drawing Sheets

APPARATUS AND METHOD FOR CONTROLLING FUEL INJECTION IN INTERNAL COMBUSTION ENGINE

BACKGROUND OF THE INVENTION

The present invention relates to an apparatus and method for controlling fuel injection in an internal combustion engine that includes a plurality of sets of fuel injection valves, each set corresponding to a single cylinder and supplying fuel to a combustion chamber of the corresponding single cylinder.

Conventionally, as an apparatus for controlling fuel injection in an internal combustion engine, the one disclosed in Japanese Laid-Open Patent Publication No. 3-185242 is known. The fuel injection controlling apparatus of the publication includes in-cylinder injectors, each of which directly injects fuel into one of combustion chambers, and port injectors, each of which injects fuel to one of intake ports. According to the operating state of an internal combustion engine, the apparatus switches between an injection mode, in which fuel is supplied to each combustion chamber by using only the in-cylinder injector in the corresponding in-cylinder injector and port injector, and another injection mode, in which fuel is supplied to each combustion chamber by using both of the corresponding in-cylinder injector and port injector.

Further, when performing feedback control to control the actual air-fuel ratio of the internal combustion engine to the stoichiometric air-fuel ratio, the fuel injection controlling apparatus learns an air-fuel ratio learning value to compensate for a steady-state deviation of the actual air-fuel ratio in relation to the stoichiometric air-fuel ratio. Specifically, the apparatus learns the air-fuel ratio learning value separately for the injection mode, in which fuel is supplied to each combustion chamber by using only the in-cylinder injector in the corresponding in-cylinder injector and port injector, and for the other injection mode, in which fuel is supplied to each combustion chamber by using both of the corresponding in-cylinder injector and port injector.

Further, in a case where the fuel injection modes of the fuel injection controlling apparatus include an injection mode, in which fuel is supplied to each combustion chamber by using only the port injector in the corresponding in-cylinder injector and port injector, the apparatus learns the air-fuel ratio learning value for this injection mode separately from the other injection modes.

However, in the injection modes in which fuel is supplied to each combustion chamber by using either one of the corresponding in-cylinder injector and port injector, learning conditions sometimes are not met. In the injection modes, until the learning conditions are met, the fuel injection amount of each injector is not corrected to compensate for the deviation of the actual air-fuel ratio in relation to a target air-fuel ratio. This may degrade the injection control performance.

SUMMARY OF THE INVENTION

Accordingly, it is an objective of the present invention to provide an apparatus and method for controlling fuel injection in an internal combustion engine, which apparatus and method, based only on an injection mode in which fuel is supplied to a combustion chamber from at least two fuel injection valves, correct the fuel injection amount of at least one of the fuel injection valves and compensate for a deviation of the actual air-fuel ratio in relation to a target air-fuel ratio.

To achieve the foregoing and other objectives and in accordance with the present invention, a fuel injection controlling apparatus for an internal combustion engine is provided. The engine includes a cylinder and a plurality of fuel injection valves for supplying fuel to a combustion chamber of the cylinder. The apparatus includes a switching section, a computing section, and a correcting section. When fuel is supplied to the combustion chamber from at least two of the fuel injection valves, the switching section switches the ratio of the fuel injection amount of each of the at least two fuel injection valves to the total fuel injection amount of the at least two fuel injection valves according to the operating state of the engine. When fuel is supplied to the combustion chamber from the at least two fuel injection valves such that the ratio of the fuel injection amount of one of the at least two fuel injection valves to the total fuel injection amount of the at least two fuel injection valves seeks a predetermined value, the computing section computes a correction value for compensating for a deviation of the actual air-fuel ratio in relation to a target air-fuel ratio. The predetermined value is switched among a plurality of different numeric values the number of which is equal to the number of the fuel injection valves. The correcting section corrects the fuel injection amount of at least one of the at least two fuel injection valves based on the numeric values and correction values. Each of the correction values is computed by the computing section when the predetermined value is a corresponding one of the numeric values.

The present invention also provides a fuel injection controlling method for an internal combustion engine. The engine includes a cylinder and a plurality of fuel injection valves for supplying fuel to a combustion chamber of the cylinder. The method includes: switching, when fuel is supplied to the combustion chamber from at least two of the fuel injection valves, the ratio of fuel injection amount of each of the at least two fuel injection valves to the total fuel injection amount of the at least two fuel injection valves according to the operating state of the engine; computing, when fuel is supplied to the combustion chamber from the at least two fuel injection valves such that the ratio of the fuel injection amount of one of the at least two fuel injection valves to the total fuel injection amount of the at least two fuel injection valves seeks a predetermined value, a correction value for compensating for a deviation of the actual air-fuel ratio in relation to a target air-fuel ratio, wherein the predetermined value is switched among a plurality of different numeric values the number of which is equal to the number of the fuel injection valves; and correcting the fuel injection amount of at least one of the at least two fuel injection valves based on the numeric values and correction values, wherein each of the correction values is computed by the computing section when the predetermined value is a corresponding one of the numeric values.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
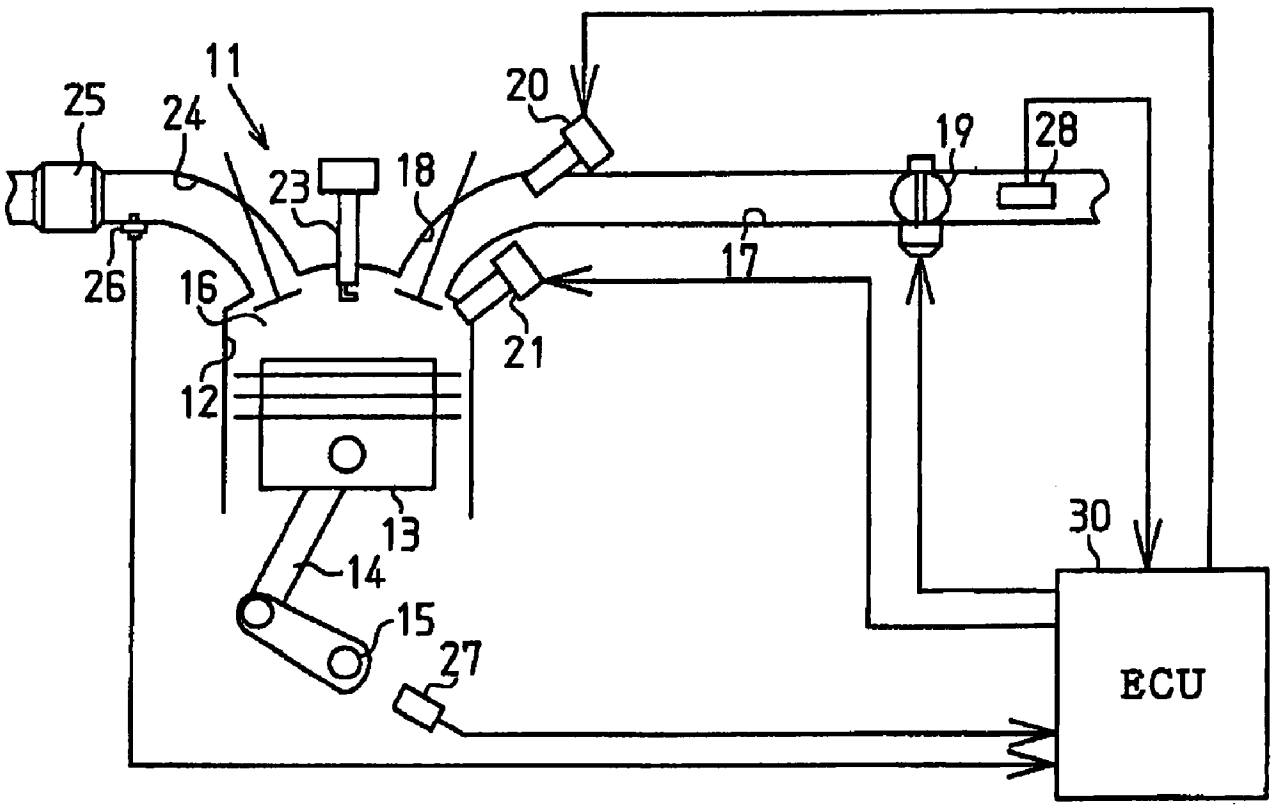
FIG. 1 is a block diagram illustrating a fuel injection controlling apparatus according to one embodiment of the present invention and an internal combustion engine to which the apparatus is applied.

On embodiment according to the present invention will now be described with reference to the drawings. In this embodiment, the present invention is applied to a gasoline engine 11 for an automobile. As shown in FIG. 1, the engine 11, which is an internal combustion engine, includes cylinders 12. A piston 13 is accommodated in each cylinder 12 to reciprocate in the cylinder 12. Each piston 13 is coupled to a crankshaft 15, which is an output shaft of the engine 11, with a connecting rod 14. Reciprocation of each piston 13 is converted into rotation of the crankshaft 15 by the corresponding connecting rod 14.

A combustion chamber 16 is defined in each cylinder 12. Air is supplied to the combustion chamber 16 of each cylinder 12 through an intake passage 17 and an intake port 18. A throttle valve 19 is located in the intake passage 17. The throttle valve 19 is opened and closed for adjusting the amount of air (intake air amount) to be supplied to the combustion chambers 16. The opening degree of the throttle valve 19 is adjusted according to the depression degree of an accelerator pedal manipulated by a driver of the automobile.

A first fuel injection valve, which is a port injector 20, and a second fuel injection valve, which is an in-cylinder injector 21, are provided for each cylinder 12 of the engine 11. Each port injector 20 injects fuel toward the intake port 18 of the corresponding cylinder 12, thereby supplying fuel to the combustion chamber 16 of the cylinder 12. Each in-cylinder injector 21 directly injects fuel into the combustion chamber 16 of the corresponding cylinder 12.

Fuel supplied to each combustion chamber 16 by using at least one of the corresponding port injector 20 and in-cylinder injector 21 is mixed with air supplied to the combustion chamber 16. The air-fuel mixture is ignited by an ignition plug 23 and burned. High temperature and high pressure combustion gas is thus generated and reciprocates the corresponding piston 13. Accordingly, the crankshaft 15 is rotated, and driving force (output torque) of the engine 11 is generated. After being burned, the air-fuel mixture, or exhaust gas, is discharged to an exhaust passage 24. A catalytic converter 25 having a three-way catalyst is located in the exhaust passage 24 to purify exhaust gas.

An air-fuel ratio sensor 26 for detecting the actual air-fuel ratio of air-fuel mixture is located in a section of the exhaust passage 24 that is upstream of the catalytic converter 25. The air-fuel ratio sensor 26 is a linear air-fuel ratio sensor that outputs a substantially linear signal that is proportionate to the actual air-fuel ratio. An air-fuel ratio AF detected by the air-fuel ratio sensor 26 is regarded to be 1.0 when the actual air-fuel ratio is equal to the stoichiometric air-fuel ratio, which is a target air-fuel ratio. The detected air-fuel ratio AF becomes greater than 1.0 proportionally as the actual air-fuel ratio becomes richer compared to the stoichiometric air-fuel ratio, and becomes smaller than 1.0 proportionally as the actual air-fuel ratio becomes leaner compared to the stoichiometric air-fuel ratio.

The engine 11 is controlled by an electronic control unit (ECU) 30. The electronic control unit 30 comprises a digital computer, which includes a central processing unit (CPU), read-only memory (ROM) storing various programs and maps, random access memory (RAM) capable of reading and storing various data, and backup RAM for storing various data after electricity supply is stopped. The electronic control unit 30 receives detection signals from various sensors for detecting the operating state of the engine 11, which sensors include the air-fuel ratio sensor 26, a crank angle sensor 27, and an airflow meter 28. The crank angle sensor 27 detects a crank angle, which is the rotation angle of the crankshaft 15, and an engine speed N, which the rotational speed of the crankshaft 15. The airflow meter 28 detects an air amount Q, which is the flow rate of intake air through the intake passage 17. Based on detection signals of these sensors, the electronic control unit 30 controls components of the engine 11 such as the port injectors 20 and the in-cylinder injectors 21.

Fuel injection control of the engine 11 performed by the electronic control unit 30 will now be described.

Figure 2:
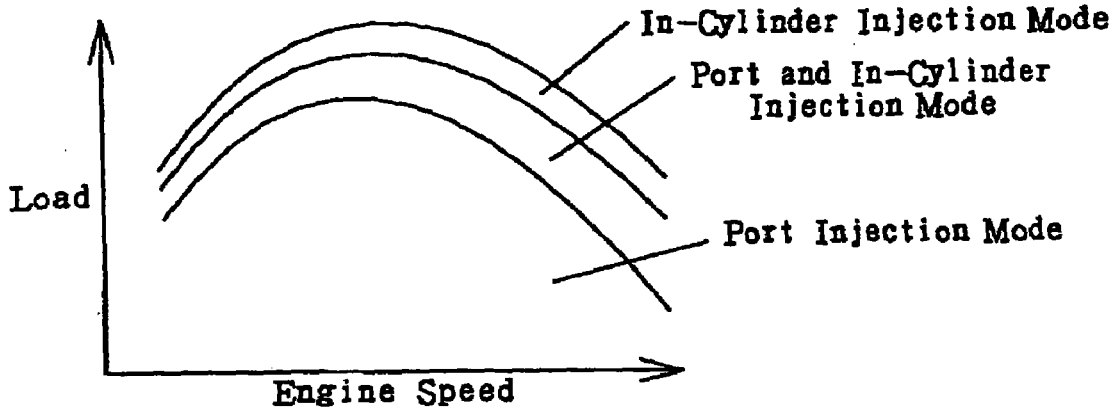
FIG. 2 is a map showing the relationship between the operating state of the engine and the fuel injection mode according to the embodiment of FIG. 1.

FIG. 2 is a map showing the relationship between the operating state of the engine 11 and the fuel injection mode according to the present embodiment. As shown in FIG. 2, according to the engine speed N and the load of the engine 11, the fuel injection mode is switched among an injection mode (port injection mode) in which fuel is supplied to each combustion chamber 16 by using only the port injector 20 in the corresponding the port injector 20 and in-cylinder injector 21, an injection mode (in-cylinder injection mode) in which fuel is supplied to each combustion chamber 16 by using only the in-cylinder injector 21 in the corresponding injectors 20, 21, and an injection mode (port and in-cylinder injection mode) in which fuel is supplied to each combustion chamber 16 by using both of the corresponding injectors 20, 21. The load of the engine 11 is an amount that is defined, for example, by the intake air amount per rotation of the engine 11. The intake air amount per rotation of the engine 11 is represented by an expression Q/N.

As shown in FIG. 2, almost irrespective to the engine speed N, the fuel injection mode is set to the port injection mode when the opening degree of the throttle valve 19 is in a range from zero to an intermediate level, that is, in an operating range of low to intermediate engine load. In this case, fuel is supplied to each combustion chamber 16 by the corresponding port injector 20. When the throttle valve 19 is fully or substantially fully open, that is, in an operating range of maximum values of the engine load (the maximum values of the intake flow rate), the fuel injection mode is set to the in-cylinder injection mode, in which fuel is supplied to each combustion chamber 16 by the corresponding in-cylinder injector 21. In an operating range of the engine load between the above described ranges, the fuel injection mode is set to the port and in-cylinder injection mode, in which fuel is supplied to each combustion chamber 16 by both of the corresponding port injector 20 and in-cylinder injector 21. In the port injection mode and the port and in-cylinder injection mode, the stoichiometric air-fuel ratio is set as a target air-fuel ratio. In the in-cylinder injection mode, a maximum power air-fuel ratio at which the torque of the engine 11 is maximum is set to the target air-fuel ratio.

The fuel injection mode is switched according to the operating state of the engine 11 in this manner in an attempt to ensure homogeneity of air-fuel mixture and improve the power performance of the engine 11 in the high load range. That is, in the operating range from a low to intermediate engine load, the homogeneity of air-fuel mixture is ensured by supplying fuel to each combustion chamber 16 by the corresponding port injector 20. On the other hand, in the operational range of the high engine load, the filing factor of fuel to each combustion chamber 16 is increased by supplying fuel to the combustion chamber 16 by the corresponding in-cylinder injector 21. Also, the power performance of the engine 11 is improved by setting the maximum power air-fuel ratio as the target air-fuel ratio.

Figure 3:
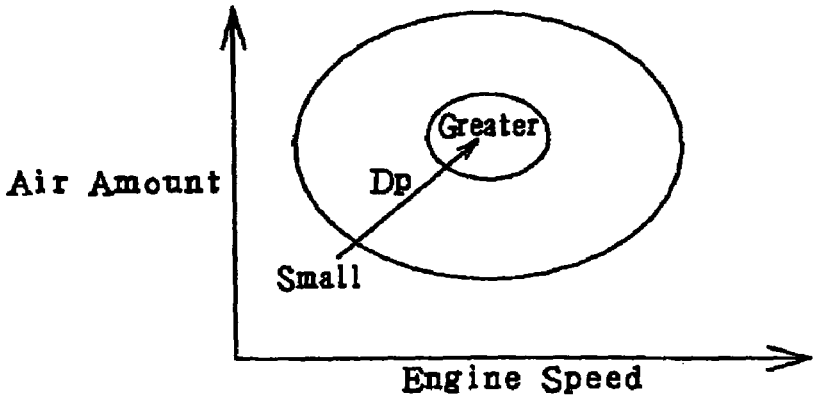
FIG. 3 is a map showing the relationship between the operating state of the engine and a port injection distribution ratio Dp according to the embodiment of FIG. 1.

FIG. 3 is a map showing the relationship between the operating state of the engine 11 and a port injection distribution ratio Dp. In the injection mode in which fuel is supplied to each combustion chamber 16 by using both of the corresponding port injector 20 and in-cylinder injector 21, the port injection distribution ratio Dp(%), which is the ratio of the fuel injection amount of the port injector 20 to the total fuel injection amount of the injectors 20, 21, is determined based on the engine speed N and the air amount Q as shown in FIG. 3. In the map of FIG. 3, the port injection distribution ratio Dp becomes greater toward the center of the concentric circles. An in-cylinder injection distribution ratio Dd (%), which is the ratio of the fuel injection amount of each in-cylinder injector 21 to the total fuel injection amount of the injectors 20, 21, is represented by 100-Dp.

A fuel injection controlling procedure according to the present embodiment will now be described with reference to the flowcharts of FIGS. 4 and 5. When executing the routine shown in the flowcharts of FIGS. 4 and 5, the electronic control unit 30 functions as a switching section, a computing section, a correcting section, and additional switching section.

Figure 4:
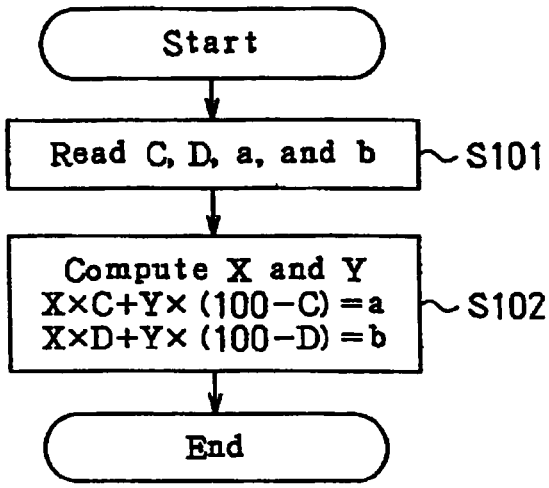
FIGS. 4 and 5 are flowcharts showing a procedure of fuel injection control according to the embodiment of FIG. 1.

FIG. 4 is a flowchart showing a routine for computing a port injection amount correction value X, which is used for correcting the fuel injection amount of each port injector 20, and an in-cylinder injection amount correction value Y, which is used for correcting the fuel injection amount of each in-cylinder injector 21. This routine is repeatedly executed by the electronic control unit 30 in an interrupting manner at every predetermined interval. The engine 11 of the present embodiment is operated in one of different ranges (correction ranges) according to the air amount Q, and the computation of the injection amount correction values X, Y is executed separately for each correction range. In each of the correction range, both injection amount correction values X, Y are computed in the manner described below.

When the routine shown in FIG. 4 is started, the electronic control unit 30 reads a first distribution ratio C, a second distribution ratio D, a first correction value a, and a second correction value b at step S101. The first and second distribution ratios C, D, and the first and second correction values a, b are stored in the backup RAM in advance on the assumption that the engine 11 is operating in a stable state after warm-up is complete.

The first distribution ratio C is the port injection distribution ratio Dp at a predetermined point in time in an injection mode in which fuel is supplied to each combustion chamber 16 by using both of the corresponding port injector 20 and in-cylinder injector 21. The first correction value a is a correction value that is computed for compensating for a deviation of the actual air-fuel ratio in relation to the stoichiometric air-fuel ratio at the predetermined point in time. Specifically, if the detected air-fuel ratio AF is 1.01 at the predetermined point in time, the first correction value a will be $(1.0-1.01)\times100=-1$. That is, when the actual air-fuel ratio is richer than the target air-fuel ratio at the predetermined point in time, in other words, when the detected air-fuel ratio AF is more than 1.0, the first correction value a is computed to be a negative value, so that the actual air-fuel ratio is made leaner to seek the target air-fuel ratio. In contrast, when the actual air-fuel ratio is leaner than the target air-fuel ratio at the predetermined point in time, that is, when the detected air-fuel ratio AF is less than 1.0, the first correction value a is computed to be a positive value, so that the actual air-fuel ratio is made richer to seek the target air-fuel ratio.

The second distribution ratio D is the port injection distribution ratio Dp that is different from the first distribution ratio C. Specifically, the second distribution ratio D is the port injection distribution ratio Dp at a predetermined point in time that is different from the above predetermined point in time in an injection mode in which fuel is supplied to each combustion chamber 16 by using both of the corresponding port injector 20 and in-cylinder injector 21. The second correction value b is a correction value that is computed for compensating for a deviation of the actual air-fuel ratio in relation to the stoichiometric air-fuel ratio at the predetermined different point in time. As in the case of the first correction value a, when the actual air-fuel ratio is richer than the target air-fuel ratio at the predetermined different point in time, the second correction value b is computed to be a negative value. When the actual air-fuel ratio is leaner than the target air-fuel ratio at the predetermined different point in time, the second correction value b is computed to be a positive value.

At nest step S102, the electronic control unit 30 solves the following simultaneous equations to compute the port injection amount correction value X and the in-cylinder injection amount correction value Y.

$$X\times C+Y\times(100-C)=a$$

$$X\times D+Y\times(100-D)=b$$

The reason why the injection amount correction values X, Y are computed by solving the simultaneous equations is that each of the first and second correction values a and b is equal to the sum of a value obtained by multiplying the port injection amount correction value X by the port injection distribution ratio Dp and a value obtained by multiplying the in-cylinder injection amount correction value Y by the in-cylinder injection distribution ratio Dd, that is, each of the correction values a and b is equal to the sum of the fuel injection amount to be corrected of the port injector 20 and the fuel injection amount to be corrected of the in-cylinder injector 21. Each of the first and second correction values a and b is not a value obtained by subtracting the detected air-fuel ratio AF at the predetermined point in time or the predetermined different point in time from 1.0, but is a value obtained by multiplying the subtraction result by 100. The multiplication is performed for aligning the digits in the simultaneous equations with the first and second distribution ratios C, D, which are expressed in percentage. As obvious from the simultaneous equations, the first and second correction values a and b become greater positive values as the injection amount correction values X, Y have greater positive values. Accordingly, the air-fuel ratio is made richer to seek the target air-fuel ratio. On the other hand, the first and second correction values a and b become greater negative values as the injection amount correction values X, Y have greater negative values. Accordingly, the air-fuel ratio is made leaner to seek the target air-fuel ratio.

The electronic control unit 30 stores the computed injection amount correction values X, Y in the backup RAM, while relating the values X, Y to a correction range during the execution of the current routine, and then ends the current routine.

Figure 5:
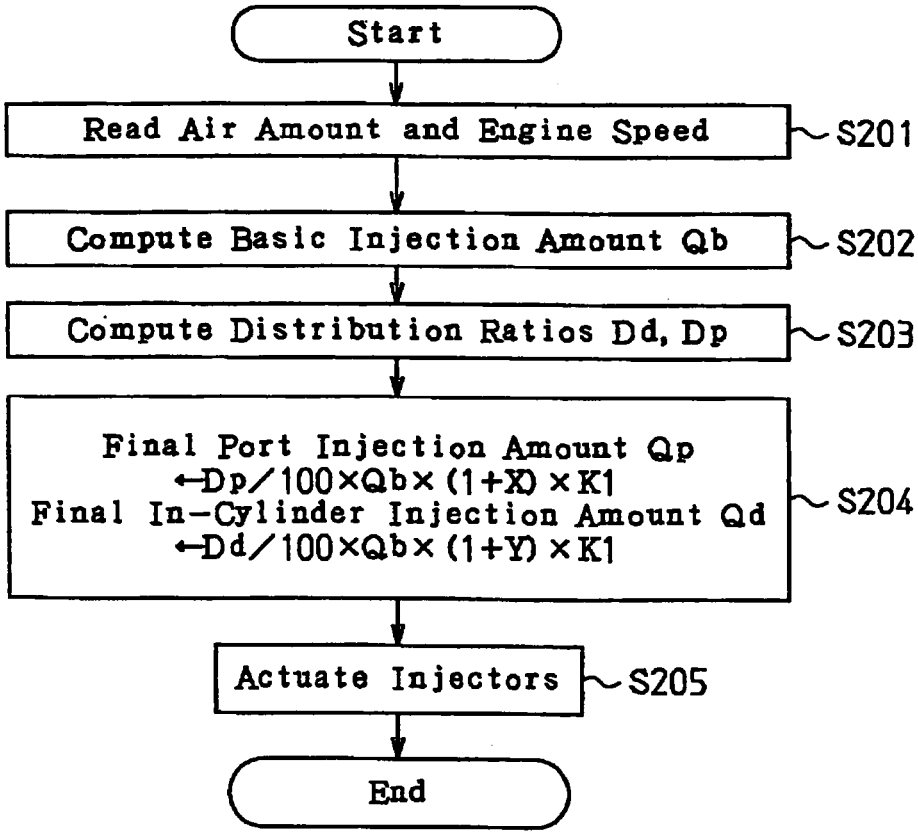

FIG. 5 is a flowchart showing a routine for controlling fuel injection using the injection amount correction values X, Y. This routine is repeatedly executed by the electronic control unit 30 in an interrupting manner at every predetermined crank angle.

When the routine of FIG. 5 is started, the electronic control unit 30 reads various data such as the air amount Q and the engine speed N at step S201. In next step S202, the electronic control unit 30 computes a basic injection amount Qb based on the air amount Q and the engine speed N. The computed basic injection amount Qb has different setting according to the fuel injection mode. That is, when the electronic control unit 30 determines that the obtained engine speed N and engine load (Q/N) correspond to the port injection mode or the port and in-cylinder injection mode using the map of FIG. 2, the electronic control unit 30 computes the basic fuel injection amount Qb based on the stoichiometric air-fuel ratio. On the other hand, when determining that the engine speed N and the engine load (Q/N) correspond to the in-cylinder injection mode, the electronic control unit 30 computes the basic fuel injection amount Qb based on the maximum power air-fuel ratio.

Next, the electronic control unit 30 computes the injection distribution ratios Dp, Dd to be set based on the maps of FIGS. 2 and 3. Specifically, when the electronic control unit 30 determines that the obtained engine speed N and engine load (Q/N) correspond to the port injection mode using the map of FIG. 2, the electronic control unit 30 sets the port injection distribution ratio Dp to 100 and the in-cylinder injection distribution ratio Dd to 0. On the other hand, when determining that the engine speed N and engine load (Q/N) correspond to the in-cylinder injection mode, the electronic control unit 30 sets the port injection distribution ratio Dp to 0 and the in-cylinder injection distribution ratio Dd to 100. Further, when determining that the engine speed N and engine load (Q/N) correspond to the port and in-cylinder injection mode, the electronic control unit 30 computes the injection distribution ratios Dp, Dd based on the obtained engine speed N and air amount Q using the map of FIG. 3 (Dp and Dd are both greater than 0 and less than 100).

At next step S204, the electronic control unit 30 computes a final port injection amount Qp of each port injector 20 and a final in-cylinder injection amount Qd of each in-cylinder injector 21 based on the following equations.

$$Qp=Dp/100\times Qb\times(1+X)\times K1$$

$$Qd=Dd/100\times Qb\times(1+Y)\times K1$$

The injection distribution ratios Dp, Dd are divided by 100 in the above equations for converting the injection distribution ratios Dp, Dd, which are expressed in percentage, into ratios compatible with 1.0. K1 in the equations is a correction factor that is set based, for example, on the coolant temperature of the engine 11.

The final port injection amount Qp is increased as the port injection amount correction value X has a greater positive value, and is decreased as the port injection amount correction value X has a greater negative value. The final in-cylinder injection amount Qd is increased as the in-cylinder injection amount correction value Y has a greater positive value, and is decreased as the in-cylinder injection amount correction value Y has a greater negative value. In this manner, the basic fuel injection amount Qb is corrected to compensate for the deviation of the actual air-fuel ratio in relation to the target air-fuel ratio (the target air-fuel ratio being the stoichiometric air-fuel ratio in the port injection mode and the port and in-cylinder injection mode, and the maximum power air-fuel ratio in the in-cylinder injection mode), so that the final port injection amount Qp and the final in-cylinder injection amount Qd are computed.

At next step S205, the electronic control unit 30 actuates the port injectors 20 such that fuel the amount of which corresponds to the final port injection amount Qp is injected by each port injector 20. The electronic control unit 30 also actuates the in-cylinder injectors 21 such that fuel the amount of which corresponds to the final in-cylinder injection amount Qd is injected by each in-cylinder injector 21. Accordingly, fuel is supplied to each combustion chamber 16 of the engine 11 from at least one of the corresponding port injector 20 and in-cylinder injector 21. Thereafter, the electronic control unit 30 ends the current routine.

The present embodiment has the following advantages.

(1) According to the present embodiment, the fuel injection amounts of the injectors 20, 21 are corrected not only in an injection mode in which fuel is supplied to each combustion chamber 16 by using one of the corresponding injectors 20, 21 (the port injection mode or the in-cylinder injection mode), but also in an injection mode in which fuel is supplied to each combustion chamber 16 by using both of the corresponding injectors 20, 21 (the port and in-cylinder injection mode). Therefore, even if conditions for correcting the fuel injection amount of the injectors 20 or the injectors 21 are hardly met in the port injection mode or the in-cylinder injection mode, the fuel injection amount from each of the injectors 20, 21 is corrected based on the result of correction in the port and in-cylinder injection mode. Thus, according to the present embodiment, the fuel injection amount of each of the injectors 20, 21 is corrected based only on the port and in-cylinder injection mode. Specifically, in the port injection mode, the fuel injection amount of each port injector 20 is corrected to compensate for the deviation of the actual air-fuel ratio in relation to the stoichiometric air-fuel ratio. In the in-cylinder injection mode, the fuel injection amount of each in-cylinder injector 21 is corrected to compensate for the deviation of the actual air-fuel ratio in relation to the maximum power air-fuel ratio. As a result, the injection control performance is improved.

(2) According to the present embodiment, learning correction of the fuel injection amount in an injection mode for supplying fuel to each combustion chamber 16 by using only one of the corresponding port injector 20 and in-cylinder injector 21, such as the learning correction disclosed in Japanese Laid-Open Patent Publication No. 3-185242, can be omitted. This reduces the computation load of the electronic control unit 30.

The preferred embodiment may be modified as follows.

The switching between the fuel injection by the injectors 20, 21 according to the first distribution ratio C and the fuel injection by the injectors 20, 21 according to the second distribution ratio D (D≠C), that is, the switching of the port injection distribution ratio Dp in the same correction range does not need to be executed based on the operating state of the engine 11, but may be forcibly performed irrespective of the operating state of the engine 11. Compared to the switching based on the operating state, the forcible switching causes the injection amount correction amount X, Y to be computed more frequently. This increases the occasions of the injection amount correction, which further improves the injection controlling performance. The condition for forcibly switching the port injection distribution ratio Dp may be met, for example, when fuel injection at a certain port injection distribution ratio Dp continues beyond a predetermined period in the same correction range.

The engine 11 may be operated in any of different ranges (correction ranges) according to the operating state of the engine 11 other than the air amount Q. Alternatively, the engine 11 may be always operated in the same correction range irrespective of the operating state. That is, the number of the correction ranges does not need to be plural.

The air amount Q may be detected by a vacuum sensor (air pressure sensor) instead of the airflow meter 28. Instead of the air amount Q, the fuel injection control may be executed using the opening degree of the throttle valve 19 or the depression degree of the accelerator pedal.

FIG. 2 only shows an example of a map showing the relationship between the operating state of the engine 11 and the fuel injection mode. The fuel injection mode may include, for example, an in-cylinder injection mode for performing stratified combustion when the engine load is low.

FIG. 3 only shows an example of a map for obtaining the port injection distribution ratio Dp based on the operating state of the engine 11. The map may be adjusted according to other factors such as the fuel consumption rate.

The first and second injection valves for supplying fuel to the combustion chamber 16 of each cylinder 12 do not need to be a port injector 20 and an in-cylinder injector 21. For example, a fuel injection valve that injects fuel into the intake passage 17 of each cylinder 12, such as a fuel injection valve that injects fuel into the surge tank of the engine 11, may be used. The first and second fuel injection valves may be used for the same purpose.

The number of fuel injection valves supplying fuel to the combustion chamber 16 of each cylinder 12 does not need to be two, but may be three or more. In this case, in an injection mode in which fuel is supplied to each combustion chamber by using at least two of the three or more fuel injection valves, correction values the number of which is equal to that of the fuel injection valves are computed for compensating for the deviation of the actual air-fuel ratio in relation to a target air-fuel ratio. Then, using the computed correction values, simultaneous equations the number of which is equal to that of the fuel injection valves are solved as in the manner shown in the above embodiment. In this manner, injection amount correction values each corresponding to one of the fuel injection valves are obtained. The fuel injection valves for supplying fuel to each combustion chamber 16 may be used for different purposes or for the same purpose.

The invention claimed is:

1. A fuel injection controlling apparatus for an internal combustion engine, the engine including a cylinder and a plurality of fuel injection valves for supplying fuel to a combustion chamber of the cylinder, the apparatus comprising:

a switching section, wherein, when fuel is supplied to the combustion chamber from at least two of the fuel injection valves, the switching section switches the ratio of the fuel injection amount of each of the at least two fuel injection valves to the total fuel injection amount of the at least two fuel injection valves according to the operating state of the engine;

a computing section, wherein, when fuel is supplied to the combustion chamber from the at least two fuel injection valves such that the ratio of the fuel injection amount of one of the at least two fuel injection valves to the total fuel injection amount of the at least two fuel injection valves seeks a predetermined value, the computing section computes a correction value for compensating for a deviation of the actual air-fuel ratio in relation to a target air-fuel ratio, wherein the predetermined value is switched among a plurality of different numeric values the number of which is equal to the number of the fuel injection valves; and a correcting section that corrects the fuel injection amount of at least one of the at least two fuel injection valves based on the numeric values and correction values, wherein each of the correction values is computed by the computing section when the predetermined value is a corresponding one of the numeric values.

2. The apparatus according to claim 1, wherein the fuel injection valves include a first fuel injection valve and a second fuel injection valve, wherein, when fuel is supplied to the combustion chamber from the first and second fuel injection valves, the switching section switches the ratio of the fuel injection amount of each of the first and second fuel injection valves to the total fuel injection amount of the first and second fuel injection valves according to the operating state of the engine, wherein, when fuel is supplied to the combustion chamber from the first and second fuel injection valves such that the ratio of the fuel injection amount of one of the first and second fuel injection valves to the total fuel injection amount of the first and second fuel injection valves seeks a first predetermined value, the computing section computes a first correction value for compensating for the deviation of the actual air-fuel ratio in relation to the target air-fuel ratio, wherein, when fuel is supplied to the combustion chamber from the first and second fuel injection valves such that the ratio of the fuel injection amount of the one of the first and second fuel injection valves to the total fuel injection amount of the first and second fuel injection valves seeks a second predetermined value that is different from the first predetermined value, the computing section computes a second correction value for compensating for the deviation of the actual air-fuel ratio in relation to the target air-fuel ratio, and wherein the correcting section corrects the fuel injection amount of at least one of the first and second fuel injection valves based on the first and second predetermined values and the first and second correction values.

3. The apparatus according to claim 2, wherein an injection amount correction value X used in correction of the fuel injection amount of the first fuel injection valve by the correcting section, and an injection amount correction value y used in correction of the fuel injection amount of the second fuel injection valve by the correcting section are computed by solving the following simultaneous equations in which the first predetermined value, the second predetermined value, the first correction value, and the second correction value are expressed by C, D, a, and b, respectively.

$$X \times C + Y \times (100 - C) = a$$

$$X \times D + Y \times (100 - D) = b$$

4. The apparatus according to claim 1, further comprising an additional switching section, wherein, when fuel is supplied to the combustion chamber from at least two of the fuel injection valves, the additional switching section forcibly switches the ratio of the fuel injection amount of each of the at least two fuel injection valves to the total fuel injection amount of the at least two fuel injection valves irrespective of the operating state of the engine.

5. The apparatus according to claim 2, further comprising an additional switching section, wherein, when fuel is supplied to the combustion chamber from the first and second fuel injection valves, the additional switching section forcibly switches the ratio of the fuel injection amount of each of the first and second fuel injection valves to the total fuel injection amount of the first and second fuel injection valves irrespective of the operating state of the engine.

6. The apparatus according to claim 3, further comprising an additional switching section, wherein, when fuel is supplied to the combustion chamber from the first and second fuel injection valves, the additional switching section forcibly switches the ratio of the fuel injection amount of each of the first and second fuel injection valves to the total fuel injection amount of the first and second fuel injection valves irrespective of the operating state of the engine.

7. A fuel injection controlling method for an internal combustion engine, the engine including a cylinder and a plurality of fuel injection valves for supplying fuel to a combustion chamber of the cylinder, the method comprising:

switching, when fuel is supplied to the combustion chamber from at least two of the fuel injection valves, the ratio of fuel injection amount of each of the at least two fuel injection valves to the total fuel injection amount of the at least two fuel injection valves according to the operating state of the engine;

computing, when fuel is supplied to the combustion chamber from the at least two fuel injection valves such that the ratio of the fuel injection amount of one of the at least two fuel injection valves to the total fuel injection amount of the at least two fuel injection valves seeks a predetermined value, a correction value for compensating for a deviation of the actual air-fuel ratio in relation to a target air-fuel ratio, wherein the predetermined value is switched among a plurality of different numeric values the number of which is equal to the number of the fuel injection valves; and correcting the fuel injection amount of at least one of the at least two fuel injection valves based on the numeric values and correction values, wherein each of the correction values is computed by the computing section when the predetermined value is a corresponding one of the numeric values.

* * * * *